US007083128B2

(12) United States Patent
Yoshizawa et al.

(10) Patent No.: US 7,083,128 B2
(45) Date of Patent: Aug. 1, 2006

(54) SHREDDER AND SHREDDING METHOD

(75) Inventors: Hisae Yoshizawa, Ashigarakami-gun (JP); Katsunori Kawano, Ashigarakami-gun (JP); Jiro Minabe, Ashigarakami-gun (JP); Kazuhiro Hayashi, Ashigarakami-gun (JP); Yasuhiro Ogasawara, Ashigarakami-gun (JP); Shin Yasuda, Ashigarakami-gun (JP); Norie Matsui, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/924,770

(22) Filed: Aug. 25, 2004

(65) Prior Publication Data

US 2005/0194480 A1 Sep. 8, 2005

(30) Foreign Application Priority Data

Feb. 16, 2004 (JP) ..... 2004-038863

(51) Int. Cl.
*B02C 19/00* (2006.01)

(52) U.S. Cl. ..... 241/23; 241/65; 241/101.2; 241/236

(58) Field of Classification Search ..... 241/236, 241/100, 65, 23, 101.2
See application file for complete search history.

(56) References Cited

U.S. PATENT DOCUMENTS 4,192,467 A * 3/1980 Hatanaka ..... 241/34
4,547,002 A * 10/1985 Colgate, Jr. ..... 283/91
6,742,733 B1 * 6/2004 Huang ..... 241/36

FOREIGN PATENT DOCUMENTS

JP A 9-90665 4/1997
JP 2003-73587 * 3/2003

* cited by examiner

*Primary Examiner*—Mark Rosenbaum
(74) *Attorney, Agent, or Firm*—Oliff & Berridge, PLC

(57) ABSTRACT

A shredder that shreds a recording medium which includes, on a surface thereof, an image forming portion and a holographic memory portion in which data is recorded. The shredder includes a data destroying unit that destroys at least the data recorded in the holographic memory portion and a shredding unit that shreds the entire recording medium. Thus, when a recording medium to which has been added a holographic memory portion in which useful information is recorded is to be discarded, the data(information) recorded in the holographic memory portion can be safely destroyed so that the data can no longer be read.

21 Claims, 4 Drawing Sheets

S10

SHREDDER AND SHREDDING METHOD

CROSS-REFERENCE TO RELATED APPLICATION

This application claims priority under 35 USC 119 from Japanese Patent Application No. 2004-38863, the disclosure of which is incorporated by reference herein.

BACKGROUND OF THE INVENTION

1. Field of the Invention

The present invention relates to a shredder and a shredding method that shred a recording medium to which a holographic memory has been added.

2. Description of the Related Art

A holographic memory that records information in the form of a hologram is a three-dimensional optical memory with which recording (including temporary storage) of a large capacity is possible. A holographic memory is also a page-type memory that has high-speediness resulting from lump recording/playback of two-dimensional data per page unit. For this reason, holographic memories are gaining attention as next-generation recording media.

As one example of an application of a holographic memory to an image recording medium (recorded medium), a holographic memory with which high-density recording is possible is disposed on the surface of an image recording medium, and information is recorded in this holographic memory. Thus, it becomes possible for the image recording medium to provide the large amount of information recorded in the holographic memory in addition to image information viewed from the surface of the image recording medium.

For example, an OHP sheet that includes a transparent plastic film and a receiving layer, which comprises a light-transmitting resin that receives toner, has been proposed. A transparent hologram that manifests a reproduced image or changes in the amount of transmitted light, where diffracted light has been attenuated, is disposed on the surface of the OHP sheet for verifying the authenticity of the OHP sheet (e.g., see Japanese Patent Application Laid-Open Publication No. 9-90665).

In a Fourier transform hologram where an image is Fourier-transformed with a lens and recorded, image information is dispersed and recorded on a recording surface in correspondence to the spatial frequency thereof. With such a Fourier transform hologram, the entire image can be read even with a portion thereof. For this reason, even if such an image recording medium is shredded with a shredder, the holographic memory portion is only shredded to a piece of about several millimeters, and the holographic information dispersed and recorded in that portion is not shredded. Thus, the data recorded in the holographic memory is readable and there is the potential for the information that had been recorded, such as confidential information, to leak to the outside.

Although holographic memories are extremely useful recording media that are thin and can be written/read even if they are folded or cut small to a piece of about several millimeters, the problem of security at the discarding stage remains. Namely, as long as a portion of the memory is readable, there is the potential for the content of the information that had been recorded in the entire memory to be read.

SUMMARY OF THE INVENTION

The present invention solves the above-described conventional problem. Namely, the present invention provides a shredder and a shredding method which, when a recording medium to which has been added a holographic memory in which useful information has been recorded is to be discarded, safely destroy data (information) recorded in the holographic memory so that the data can no longer be read.

The invention provides a shredder that shreds a recording medium which includes, on a surface thereof, an image forming portion and a holographic memory portion in which data is recorded, the shredder including a data destroying unit that destroys at least the data recorded in the holographic memory portion and a shredding unit that shreds the entire recording medium.

The data destroying unit can erase the recorded data by at least one of heating the holographic memory portion, irradiating the holographic memory portion with light or applying an electric field to the holographic memory portion.

In the case of heating, the holographic memory portion can be heated so that the surface temperature of the holographic memory portion becomes equal to or greater than a temperature at which the refractive index and/or the absorption coefficient of a holographic recording material configuring the holographic memory portion changes.

In the case of irradiation with light, the holographic memory portion can be irradiated with laser light having a wavelength in the range of 200 to 1500 nm.

The data destroying unit may overwrite the holographic memory portion using laser light.

Alternatively, the data destroying unit applies an opaque material to the holographic memory portion.

The shredder of the invention can further include a detecting unit that detects the presence of the holographic memory portion, and a control unit that controls the data destroying unit so that the data destroying unit is activated when the detecting unit detects the holographic memory portion.

The shredder may also include a data destruction verifying unit that verifies the fact that the data recorded in the holographic memory portion has been destroyed.

The invention also provides a method of shredding a recording medium which includes, on a surface thereof, an image forming portion and a holographic memory portion in which data is recorded, the method including supplying the recording medium, destroying at least the data recorded in the holographic memory portion, and shredding the entire recording medium.

The shredding method may further include detecting the presence of the holographic memory portion and conducting data destruction when the holographic memory portion is detected.

Moreover, the shredding method may include verifying the fact that the data recorded in the holographic memory portion has been destroyed.

According to the invention, when a recording medium to which has been added a holographic memory in which useful information has been recorded is to be discarded, data (information) recorded in the holographic memory can be safely destroyed so that the data can no longer be read.

DETAILED DESCRIPTION OF THE INVENTION

The invention will be described in detail below. Because the shredder of the invention is disposed with a mechanism that implements-the shredding method of the invention, these will be described together.

Image Recording Medium (Recorded Medium)

Figure 1:
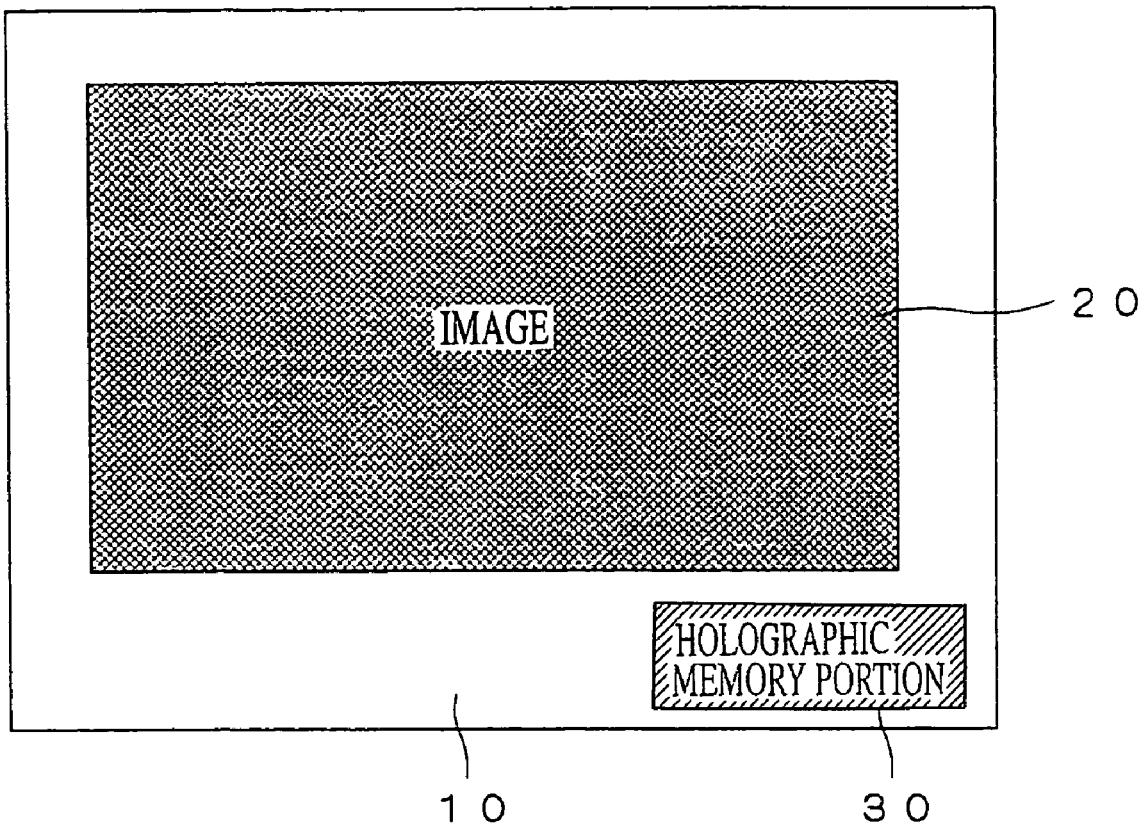
FIG. 1 is a diagram showing an example of an image recording medium that is processed by a shredder of the invention.

FIG. 1 is a front view showing an example of an image recording medium (recorded medium) processed by the shredder and the shredding method of the invention. As shown in FIG. 1, an image 20 is formed on an image forming portion of an image recording medium 10. Here, "image forming portion" refers to a portion on which an image is formable other than a later-described holographic memory portion of the recording medium. In the present invention, an image is not necessarily formed on the image forming portion.

The base material of the image recording medium is not particularly limited as long as image formation and holographic memory portion formation can be conducted and as long as it can be processed by the shredder of the invention. Preferably, paper such as common paper or plastic films such as OHP sheets are used. Also, a coat layer may be disposed on the base material or a surface treatment may be applied to the base material as needed.

The image 20 formed on the image forming portion may be formed by a printing such as offset printing or gravure printing, or by inkjet printing, thermal transfer printing or electrophotography. The image 20 formed by these may be, for example, confidential information and is preferably postprocessed after being browsed so that it can no longer be viewed.

A holographic memory portion 30 is also added to the image recording medium 10. As for the holographic memory portion 30 added to the image recording medium 10, data can be read in a non-contact state. For example, information that is more confidential than the confidential information of the image 20 formed on the surface of the image recording medium 10 is recorded in the holographic memory portion 30. It is preferable for the information recorded in the holographic memory portion 30 to also be processed after being browsed so that it can no longer be read.

The material configuring the holographic memory portion 30 may be any material as long as its refractive index or absorption coefficient can be changed to record a hologram and the changed refractive index or absorption coefficient is maintained at room temperature. However, in the present invention, it is preferable for the material to be one where data erasure is possible with a later-described data destroying unit.

Preferable examples of the material include polymer materials with which holographic recording is possible. Specifically, it is preferable to use a photopolymer or an azopolymer.

FIRST EMBODIMENT

Figure 2:
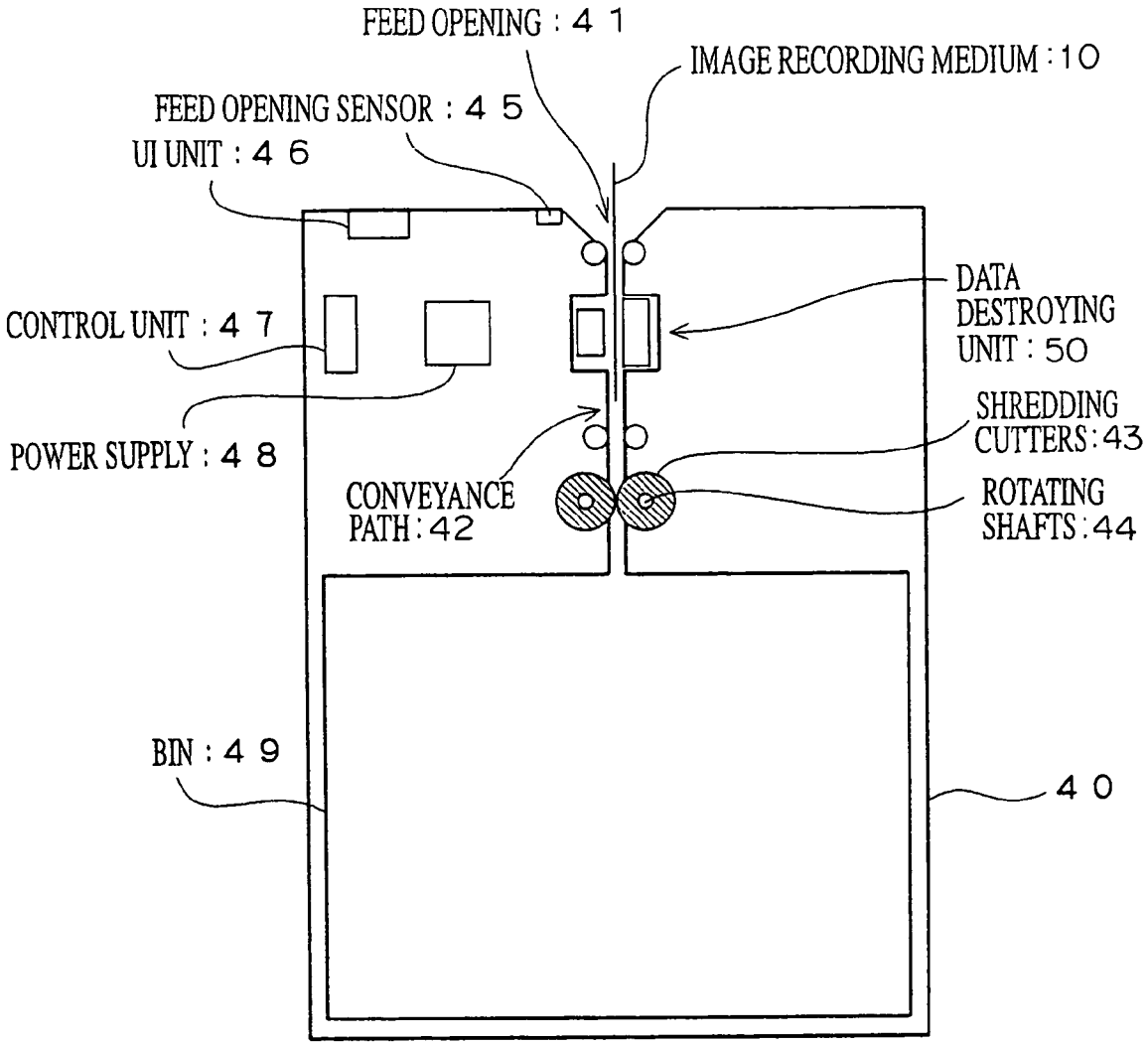
FIG. 2 is a schematic diagram showing an example of a configuration of the shredder of the invention.

FIG. 2 is a schematic diagram showing an example of a configuration of a shredder to which the shredding method of the invention is applied. As shown in FIG. 2, a shredder 40 is configured by a control unit 47 that controls the operation of each constituent unit of the shredder, a power supply 48 that supplies electrical power to each constituent unit of the shredder, a user interface unit (UI unit) 46 that includes an LCD display or a CRT display and a keyboard/touch panel, a feed opening sensor 45, a data destroying unit 50 that heats the holographic memory portion and/or irradiates the holographic memory portion with light or the like, shredding cutters 43 (shredding unit) that shred the image recording medium 10, and a bin 49 that accommodates the shredded image recording medium 10.

A feed opening 41 for feeding the image recording medium 10 is also formed in an upper portion (as seen in the drawing) of the casing of the shredder 40. A conveyance path 42 that conveys the image recording medium 10 fed through the feed opening 41 is formed inside the casing of the shredder 40. The conveyance path 42 conveys the image recording medium 10 shredded by the shredding cutters 43 (may be referred to hereafter as "shreds") to the bin 49.

The UI unit 46 is disposed in the upper portion (as seen in the drawing) of the shredder 40 and displays the status ("In Operation", "Full of Shreds", etc.) of the shredder 40. The feed opening sensor 45 is, for example, an optical sensor that detects the presence of the image recording medium 10, is disposed near the feed opening 41 and detects the image recording medium 10 fed through the feed opening 41. However, when the feed opening sensor 45 has a later-described dual function of detecting the presence of the holographic memory portion, the feed opening sensor 45 serves as a detecting unit of the invention.

The data destroying unit 50 is disposed near the conveyance path 42 and heats the image recording medium 10 and/or irradiates the image recording medium 10 with light. The shredding cutters 43 are cutting blades where side surfaces of opposing rotating bodies mutually contact each other, and are disposed in the conveyance path 42. The rotating bodies of the shredding cutters 43 respectively include rotating shafts 44, obtain driving force from a motor (not shown), rotate in directions that pull the image recording medium 10 into the bin 49, and shred the image recording medium 10 being conveyed along the conveyance path 42 (shredding). It is preferable for the shredding cutters 43 to finely shred the image recording medium 10 to the extent that the image printed on the image recording medium 10 can no longer be viewed.

The bin 49 accommodates the shreds of the image recording medium 10 shredded by the shredding cutters 43. The bin 49 includes a removal opening (not shown) for removing the shreds. The shreds accumulated in the bin 49 are removed through the removal opening and discarded.

Data Destroying Unit

Data destruction by the data destroying unit of the present invention is conducted mainly by one of two techniques: (1) erasing the data recorded in the holographic memory portion, and (2) making the data stored in the holographic memory portion unreadable.

For the technique (1) that erases the data, it is preferable to use a technique that causes the recorded data to be erased by heating the holographic memory portion 30, irradiating the holographic memory portion 30 with light, or applying an electric field to the holographic memory portion 30. This is because, in a case where data is recorded by minute convex and concave portion formed on the surface of a holographic recording material, the data can be easily erased by smoothing the minute bumps with light irradiation, heat or the application of an electric field. This is also because, in a case where data is recorded by changing the internal refractive index of the holographic recording material, the data can be erased by making uniform overall the internal refractive index with light irradiation, heat or the application of an electric field. The data can be similarly erased even in a case where the data is recorded by both minute bumps and changing the internal refractive index.

Examples of the irradiation with light include a method where the image recording medium 10 or only the holographic memory portion 30 is irradiated with uniform light. The irradiation with light in this case is preferably conducted by imparting exposure energy equal to or greater than that at the time of data recording. The exposure energy is preferably at least 5 $mJ/cm^2$ and more preferably at least 10 $mJ/cm^2$. Also, the irradiation with light is conducted using a semiconductor laser, an argon laser or a semiconductor excitation solid-state laser.

In the present invention, the wavelength of the laser light is not particularly limited. Laser light of any wavelength can be accommodated.

For erasing the data of the hologram by applying an electric field, a method where the holographic memory portion 30 is passed through an electric field to the extent that the refractive index and/or the absorption coefficient of the holographic material changes is preferable. In addition to ordinary electric field application, corona discharge can also be used for the method.

Examples of other techniques of erasing the data include overwriting the holographic memory portion 30 using laser light. By "overwriting" is meant writing information over the recorded data. In this case, overwriting can be done by simultaneously irradiating the data portion with signal beams and reference beams as the laser light. With respect to the wavelength of the laser light used here, laser light of any wavelength may be used without relation to the wavelength of the laser light used when the original data was written. Using the above-described techniques, the data of the holographic memory can be selectively erased with a simple method.

The method for conducting heating is not particularly limited, but from the perspective of ensuring device safety, it is preferable to use a technique that can instantaneously heat the holographic memory portion, such as flash exposure. In a case where a polymer is used as the holographic recording material, it is preferable to heat the surface of the holographic memory portion 30 with a hot press so that the surface temperature becomes equal to or greater than a temperature at which the refractive index and/or the absorption coefficient of the recording material changes. By heating the holographic memory portion in this manner, the recorded data can be erased in a short period of time.

Examples of temperatures at which the refractive index and/or the absorption coefficient of the holographic recording material configuring the holographic memory portion changes include the glass transition point and the melting point.

Examples of the technique (2) for making the data unreadable include a technique where an opaque material is coated on the holographic memory portion. Specifically, for example, when the holographic memory portion 30 of the image recording medium 10 fed through the feed opening 41 shown in FIG. 2 passes the position of the data destroying unit 50, an opaque material may be sprayed on the holographic memory portion 30 to form a light-reflecting film or a light-absorbing film so that data reading light cannot be transmitted therethrough.

As the opaque material, a material is used that can cover the holographic recording material so that light does not reach the holographic recording material, such as a coating liquid in which an opaque pigment such as carbon black is dispersed or a coating liquid where a crystalline resin such as polyethylene terephthalate is dissolved. For these opaque materials, it is preferable to use a material that adheres well to the holographic recording material so that the opaque material does not easily peel away when it is coated into a film. For the solvent of the coating liquid, it is preferable to use a solvent that dissolves the holographic recording material.

As for the spraying method, a method can be used where a head having plural nozzles is disposed in the data destroying unit 50 and the coating liquid is continuously sprayed through the nozzles by, for example, piezo pressurization.

Also, as long as the data destroying unit is disposed further upstream in the conveyance direction of the recording medium than the shredding unit that shreds the entire recording medium, shredding can be conducted efficiently.

Operation of the Shredder

Next, the operation (shredding method) of the shredder of the invention will be described.

Figure 3:
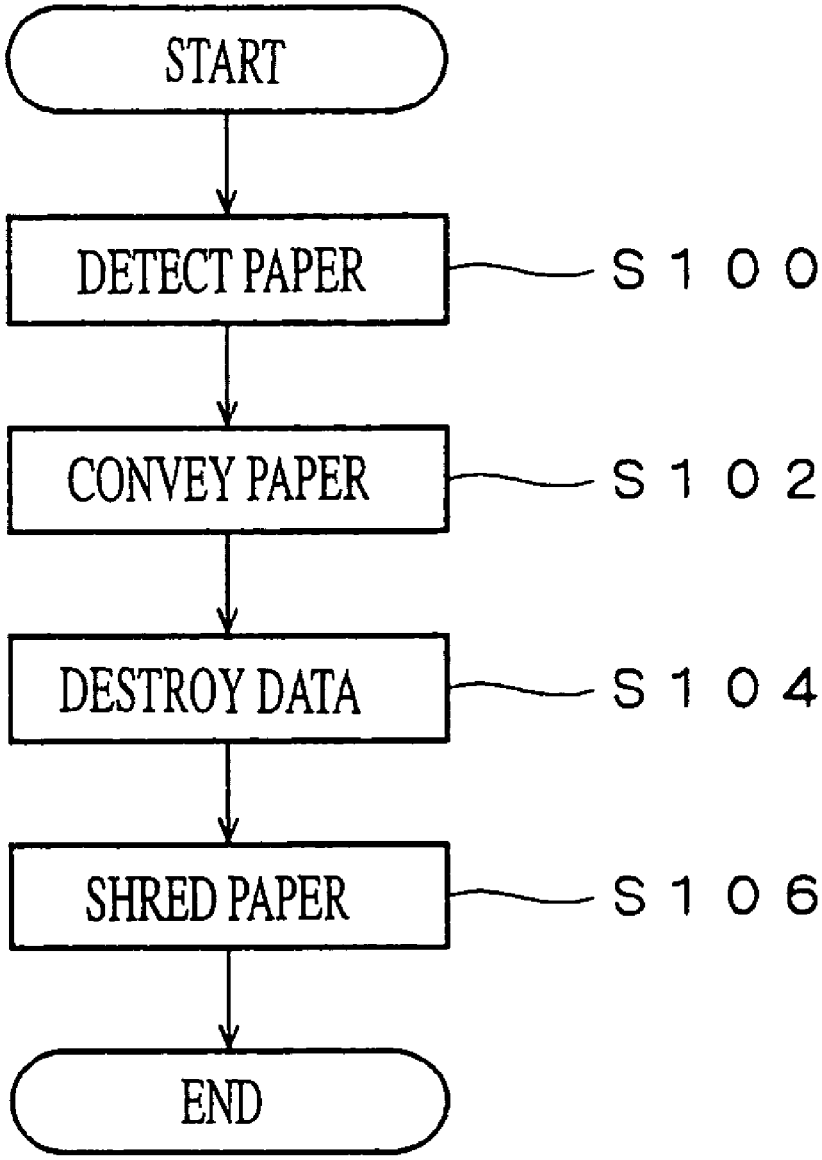
FIG. 3 is a flow chart showing the operation of the shredder of the invention.

FIG. 3 is a flow chart showing the operation (S10) of the shredder 40 shown in FIG. 2. As shown in FIG. 3, in step 100 (S100), when the user feeds, through the feed opening 41, the image recording medium 10 to be discarded as shown in FIG. 2, the feed opening sensor 45 detects the fact that paper (image recording medium 10) has been fed and conveys this result to the control unit 47. The control unit 47 controls each constituent unit to begin shredding of the image recording medium 10.

Specifically, for example, when the image recording medium 10 is detected by the feed opening sensor 45, the control unit 47 controls the data destroying unit 50 to begin data destruction and controls the shredding cutters 43 to begin shredding. Also, in accordance with the control of the control unit 47, the power supply 48 supplies electrical power to the data destroying unit 50.

In step 102 (S102), the conveyance path 42 of FIG. 2 conveys the fed paper (image recording medium 40) to the position of the data destroying unit 50 in response to the control of the control unit 47. Next, in step 104 (S104), the data destroying unit 50 of FIG. 2 conducts data destruction such as heating the conveyed image recording material 10 and/or irradiating the conveyed image recording medium 10 with light or the like.

Next, in step 106 (S106), when the image recording medium 10 passes through the conveyance path 42 and is conveyed to the position of the shredding cutters 43 after data destruction, the shredding cutters 43 rotate and shred the paper (image recording medium 10). The shredder 40 conveys the shredded image recording medium 10 to the bin 49, and processing ends.

As described above, the shredder 40 conducts data destruction with respect to the image recording medium 10 and erases or makes unreadable the data stored in the holographic memory portion 30 added to the image recording medium 10 (including partially erasing the data or partially making the data unreadable). Moreover, the shredder 40 shreds the image recording medium 10 so that the image 20 formed on the image recording medium 10 can no longer be viewed.

SECOND EMBODIMENT

The shredder 40 may also be configured to detect whether or not the holographic memory portion 30 has been added to the image recording medium 10 and to destroy the data in the holographic memory portion 30 when it is detected that the holographic memory portion 30 has been added.

Figure 4:
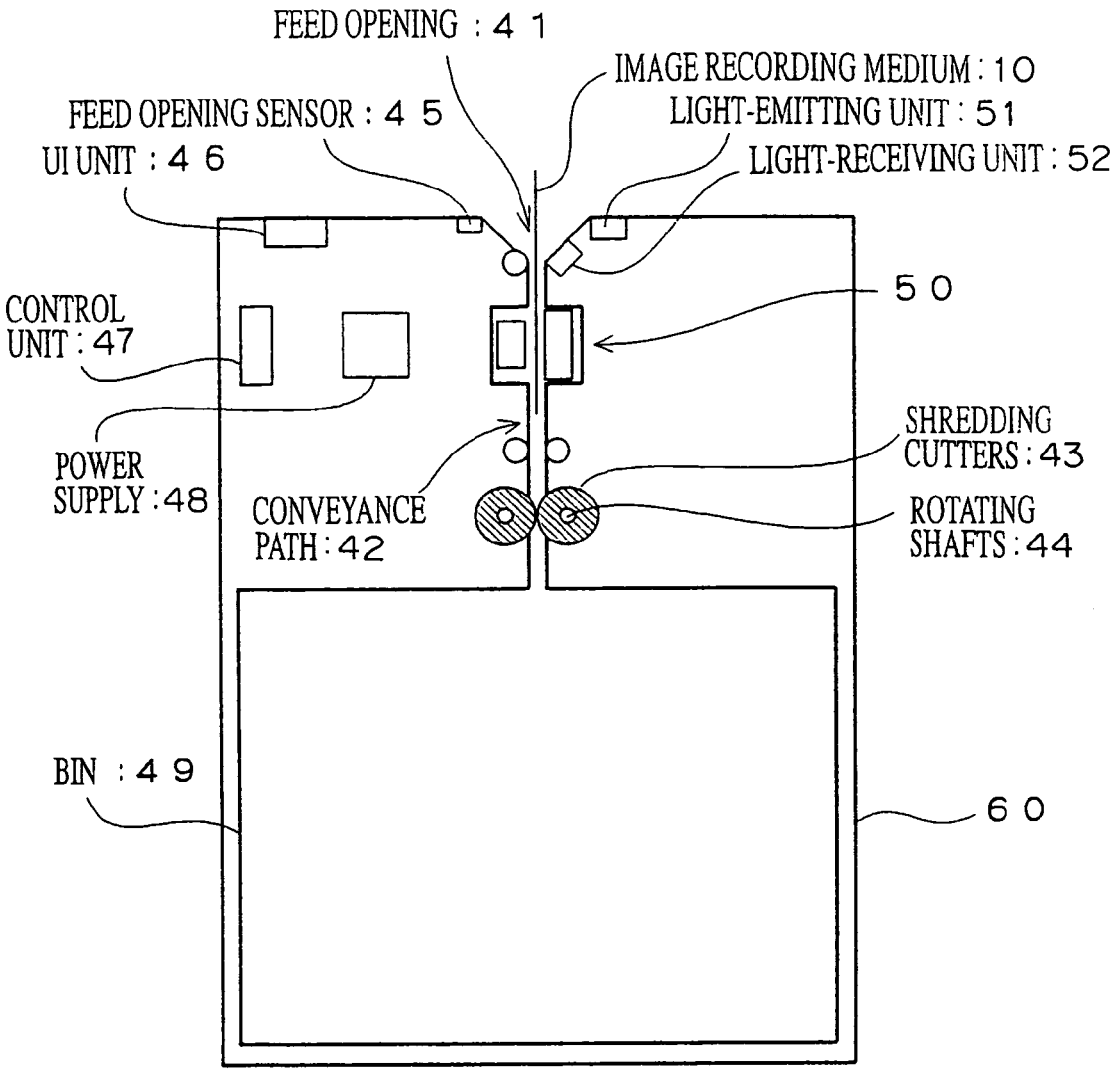
FIG. 4 is a schematic diagram showing an example of another configuration of the shredder of the invention.

FIG. 4 is a schematic diagram showing the configuration of shredder 60 of another embodiment of the invention. The same reference numerals are given to constituent units shown in FIG. 4 that are substantially identical to the constituent units shown in FIG. 2.

As shown in FIG. 4, the shredder 60 adopts a configuration where a light-emitting unit 51 and a light-receiving unit 52 are added upstream in the conveyance direction than the data destroying unit 50 of the shredder. The light-emitting unit 51 and the light-receiving unit 52 are an example of a detecting unit that detects the presence of the holographic memory portion 30. The detecting may conducted such that, for example, the image recording medium 10 fed through the feed opening 41 is irradiated with reading light, and the light is received only when a holographic memory portion is present. It may also conducted such that the presence of the holographic memory portion 30 is detected by emitting laser light to check the refractive index distribution at each position of the image recording medium 10 from the distribution of reflected light.

A device, for example, that emits illumination light that can reproduce the holographic data can be used for the light-emitting unit 51. A discharge lamp such as a sodium lamp or a metal halide lamp, a laser such as a gas laser or a semiconductor laser, an EL panel or a light-emitting diode can also be used.

Also, an imaging tube such as a photoelectric tube, an image tube, an SEC tube, a vidicon or a saticon, or solid-state imaging device, a CCD image sensor, a CMOS image sensor, a photodiode array or a phototransistor array can be used for the light-receiving unit 52. Particularly for sensing a reproduced image and converting optical information into electrical information, a CCD image sensor is preferably used for its size also.

The control unit 47 decides whether or not to activate the data destroying unit 50 of FIG. 4 on the basis of data (the presence of the holographic memory portion 30, identification information of the holographic memory portion 30, data identification information in the holographic memory portion 30, etc.) inputted from the light-receiving unit 52 and controls the data destroying unit 50.

Namely, when the control unit 47 receives the detection result of the holographic memory portion 30 from the light-receiving unit 52, the control unit 47 controls the data destroying unit 50 so that the data destroying unit 50 begins data destruction, and in cases other than this, the control unit 47 prohibits the data destroying unit 50 from conducting data destruction. In this manner, the shredder 60 begins data destruction only when the holographic memory portion 30 is detected, while data destruction is prohibited from being conducted with respect to an image recording medium 10 to which the holographic memory portion 30 has not been added, and consumption of power. Thus, the consumption of data destroying agents (opaque material, etc.) can be reduced.

OTHER EMBODIMENT

In the shredders 40 and 60 shown in FIGS. 2 and 4, the holographic memory portion 30 was destroyed using non-contact means such as irradiation with light and flash exposure, but the invention may also be configured so that, for example, a heating roll or coating roll is brought into direct contact with the image recording medium 10 to erase or make unreadable the data of the holographic memory portion 30 added to the image recording medium 10.

It is also possible to dispose a data destruction verifying unit to verify that the data recorded in the holographic memory portion has been destroyed. As long as the data destruction verifying unit is disposed further upstream in the conveyance direction of the recording medium than the shredding unit that shreds the recording medium and is disposed further downstream in the conveyance direction of the recording medium than the data destroying unit, shredding can be conducted efficiently. As an example of the verification method, in a case where the detecting unit that comprises the light-emitting unit 51 and the light-receiving unit 52 and detects the presence of the holographic memory portion 30 is disposed, light with the same angle and intensity of the light used by the light-emitting unit 51 may be emitted to verify whether or not there are differences in the diffraction, diffusion and reflection of the light before and after data destruction.

What is claimed is:

1. A shredder that shreds a recording medium which includes, on a surface thereof, an image forming portion and a holographic memory portion in which data is recorded, the shredder comprising:

a data destroying unit that destroys at least the data recorded in the holographic memory portion; and a shredding unit that shreds the entire recording medium, wherein the data destroying unit destroys the holographic memory portion by erasing the recorded data by at least one of heating the holographic memory portion, irradiating the holographic memory portion with light, or applying an electric field to the holographic memory portion, destroys the holographic memory portion by overwriting the holographic memory portion using laser light, or destroys the holographic memory portion by applying an opaque material to the holographic memory portion.

2. The shredder of claim 1, wherein the holographic memory portion is heated so that the surface temperature of the holographic memory portion becomes equal to or greater than a temperature at which the refractive index and/or the absorption coefficient of a holographic recording material configuring the holographic memory portion changes.

3. The shredder of claim 1, wherein the holographic memory portion is irradiated with laser light having a wavelength in the range of 200 to 1500 nm.

4. The shredder of claim 1, further comprising:

a feed opening through which the recording medium is fed; and a conveyance path that conveys the fed recording medium towards the data destroying unit and the shredding unit;

wherein the data destroying unit is disposed further upstream in the conveyance direction of the recording medium than the shredding unit.

5. The shredder of claim 1, further comprising:

a detecting unit that detects the presence of the holographic memory portion; and a control unit that controls the data destroying unit so that the data destroying unit is activated when the detecting unit detects the holographic memory portion.

6. The shredder of claim 5, further comprising:

a feed opening through which the recording medium is fed, wherein the detecting unit comprises a feed opening sensor that detects the fact that the recording medium has been fed through the feed opening.

7. The shredder of claim 5, further comprising:

a conveyance path that conveys the recording medium towards the data destroying unit and the shredding unit, wherein the detecting unit is disposed further upstream in the conveyance direction of the recording medium than the data destroying unit and the detecting unit comprises a light-emitting unit that irradiates the recording medium with reading light and a light-receiving unit that detects a reproduced image of a holographic portion when a holographic portion is present.

8. The shredder of claim 1, further comprising:

a data destruction verifying unit that verifies the fact that the data recorded in the holographic memory portion has been destroyed.

9. The shredder of claim 8, further comprising:

a feed opening through which the recording medium is fed; and a conveyance path that conveys the fed recording medium towards the data destroying unit and the shredding unit;

wherein the data destruction verifying unit is disposed further upstream in the conveyance direction of the recording medium than the shredding unit that shreds the entire recording medium and is disposed further downstream in the conveyance direction of the recording medium than the data destroying unit.

10. A method of shredding a recording medium which includes, on a surface thereof, an image forming portion and a holographic memory portion in which data is recorded, the method comprising:

supplying the recording medium;

destroying at least the data recorded in the holographic memory portion; and shredding the entire recording medium.

11. The shredding method of claim 10, wherein the data destruction erases the recorded data by at least one of heating the holographic memory portion, irradiating the holographic memory portion with light or applying an electric field to the holographic memory portion.

12. The shredding method of claim 11, wherein the holographic memory portion is heated so that the surface temperature of the holographic memory portion becomes a temperature equal to or greater than a temperature at which the refractive index and/or the absorption coefficient of a holographic recording material configuring the holographic memory portion changes.

13. The shredding method of claim 11, wherein the holographic memory portion is irradiated with laser light having a wavelength in the range of 200 to 1500 nm.

14. The shredding method of claim 10, wherein the data destruction is conducted by overwriting the holographic memory portion using laser light.

15. The shredding method of claim 10, wherein the data destruction is conducted by applying an opaque material to the holographic memory portion.

16. The shredding method of claim 10, further comprising:

detecting the presence of the holographic memory portion; and conducting data destruction when the holographic memory portion is detected.

17. The shredding method of claim 10, further comprising:

verifying the fact that the data recorded in the holographic memory portion has been destroyed.

18. A shredder that shreds a recording medium which includes, on a surface thereof, an image forming portion and a holographic memory portion in which data is recorded, the shredder comprising:

a data destroying unit that destroys at least the data recorded in the holographic memory portion;

a shredding unit that shreds the entire recording medium;

a detecting unit that detects the presence of the holographic memory portion; and a control unit that controls the data destroying unit so that the data destroying unit is activated when the detecting unit detects the holographic memory portion.

19. The shredder of claim 18, further comprising:

a feed opening through which the recording medium is fed, wherein the detecting unit comprises a feed opening sensor that detects the fact that the recording medium has been fed through the feed opening.

20. The shredder of claim 18, further comprising:

a conveyance path that conveys the recording medium towards the data destroying unit and the shredding unit, wherein the detecting unit is disposed further upstream in the conveyance direction of the recording medium than the data destroying unit and the detecting unit comprises a light-emitting unit that irradiates the recording medium with reading light and a light-receiving unit that detects a reproduced image of a holographic portion when a holographic portion is present.

21. A shredder that shreds a recording medium which includes, on a surface thereof, an image forming portion and a holographic memory portion in which data is recorded, the shredder comprising:

a data destroying unit that destroys at least the data recorded in the holographic memory portion;

a shredding unit that shreds the entire recording medium; and a data destruction verifying unit that verifies the fact that the data recorded in the holographic memory portion has been destroyed.

* * * * *